US008070352B2

(12) United States Patent
Heichel et al.

(10) Patent No.: US 8,070,352 B2
(45) **Date of Patent: *Dec. 6, 2011**

(54) VIBRATION EXCITER

(75) Inventors: Christian Heichel, Niedernberg (DE); Albrecht Kleibl, Grosshennersdorf (DE); Frank Hense, Gevelsberg (DE); Rolf Winzen, Bochum (DE)

(73) Assignee: ABI Anlagentechnik-Baumaschinen-Industriebedarf Maschinenfabrik und Vertriebsgesellschaft mbH, Niedernberg (DE)

( * ) Notice: Subject to any disclaimer, the term of this patent is extended or adjusted under 35 U.S.C. 154(b) by 1055 days.

This patent is subject to a terminal disclaimer.

(21) Appl. No.: 11/985,535

(22) Filed: Nov. 15, 2007

(65) Prior Publication Data

US 2008/0219085 A1 Sep. 11, 2008

(30) Foreign Application Priority Data

Mar. 7, 2007 (DE) ..... 20 2007 003 532 U

(51) Int. Cl.
*B01F 11/00* (2006.01)

(52) U.S. Cl. ..... 366/128; 173/49; 175/55

(58) Field of Classification Search ..... 173/49; 175/55; 366/123, 128
See application file for complete search history.

(56) References Cited

U.S. PATENT DOCUMENTS

| | | | | |
|---|---|---|---|---|
| 3,368,632 | A * | 2/1968 | Lebelle | 173/49 |
| 7,598,640 | B2 * | 10/2009 | Heichel et al. | 310/81 |
| 2004/0025608 | A1 * | 2/2004 | Fervers et al. | 74/1 SS |

FOREIGN PATENT DOCUMENTS

| | | |
|---|---|---|
| DE | 41 18 069 | 12/1992 |

* cited by examiner

*Primary Examiner* — David Sorkin
(74) *Attorney, Agent, or Firm* — Collard & Roe, P.C.

(57) ABSTRACT

A vibration exciter, particularly for a vibration pile driver, comprises at least two axles disposed parallel to one another, as well as at least two imbalance masses, which are attached to one or more of the axles. The relative rotary position of the imbalance masses can be adjusted relative to one another by at least one rotary oscillating motor having a rotor shaft and a stator housing. The rotor shaft is an integral part of one of the axles, and the rotary position of the stator housing relative to the rotor shaft can be changed. The stator housing has at least one closure lid that is at least partially unreleasably coated with a slide alloy, for radial and axial bearing of the rotor shaft. At least one shaft seal is disposed between the rotor shaft and stator housing. The seal is hydraulically biased and provided with a support element.

6 Claims, 7 Drawing Sheets

VIBRATION EXCITER

CROSS REFERENCE TO RELATED APPLICATIONS

Applicants claim priority under 35 U.S.C. §119 of German Application No. 20 2007 003 532.2 filed on Mar. 7, 2007.

BACKGROUND OF THE INVENTION

1. Field of the Invention

The invention relates to a vibration exciter and to an oscillating motor for use in a vibration exciter.

2. The Prior Art

In construction, vibration generators such as vibrators, shakers, or vibratory pile drivers are used to introduce or draw profiles into the ground, or also to compact soil material. The ground is excited by means of vibration, and thereby achieves a "pseudo-fluid" state. The goods to be driven in can then be pressed into the construction ground by means of a static top load. The vibration is characterized by a linear movement and is generated by means of rotating imbalances that run in opposite directions, in pairs, within a vibrator gear mechanism. Vibration generators are characterized by the imbalance that is installed (referred to as "static moment" in technical circles) and by the maximal speed of rotation.

In order to achieve an optimal advance and good compacting, as a function of the goods to be driven in and of the soil properties, it is desirable to regulate the amplitude, frequency, or force direction of the vibration generator. It is practical if the adjustment of the vibration takes place by way of a change in the static moment or the phase position of the imbalances. When the vibration exciter is started up, the inherent frequency range of the soil is passed through. If the soil is excited in the resonance range, the amplitude of the soil vibration becomes very great, and this can result in damage to adjacent buildings. Therefore, no imbalances can be in effect when the vibration exciter is started up.

Known solutions such as planetary gear mechanisms or oscillating gear trains require a lot of space, are not well suited for high speeds of rotation, and produce a high noise level because of additional gear wheels.

To solve this problem, it was proposed in German Patent No. DE 41 18 069 A1 to use a rotary piston adjustment device for orienting imbalance masses. It was shown, however, that with such devices, such as a rotor oscillating motor, leakages occur after only a short period of time at the required high hydraulic pressures that must be guaranteed over a long period of time. This makes complicated control and regulation devices necessary, in order to keep the relative position of the imbalance masses constant.

SUMMARY OF THE INVENTION

It is therefore an object of the invention to create a vibration exciter having a rotor oscillating motor, in which the effective imbalance, and therefore the vibration, is adjustable, and furthermore, in which leakages are avoided even over a longer period of time.

According to the invention, this task is accomplished by a vibration exciter comprising at least two axles disposed parallel to one another, as well as at least two imbalance masses, which are attached to one or more of the axles. There are means for adjusting the relative rotary position of the imbalance masses relative to one another. These means comprise at least one rotary oscillating motor having a rotor shaft and a stator housing. The rotor shaft is an integral part of one of the axles, and the rotary position of the stator housing relative to the rotor shaft can be changed. The stator housing has at least one closure lid that is at least partially unreleasably coated with a slide alloy, for radial and axial bearing of the rotor shaft. At least one shaft seal is disposed between the rotor shaft and stator housing. This seal is hydraulically biased and provided with a support element.

With the invention, a vibration exciter is created in which the effective imbalance, and therefore the vibration, is adjustable, and in which furthermore leakages are prevented even over a longer period of time. The use of the rotor oscillating motor allows a relative adjustment of the imbalance masses relative to one another, without any conversion of a linear movement into a rotary movement being required, thereby achieving a compact construction. External leaks at the shaft seals are avoided, in an operating state with low operating pressure, by means of the at least one shaft seal between the rotor shaft and stator housing, which is provided with a support element and hydraulically biased. Lifting of the sealing edge of the shaft seal, at high speeds of rotation or vibrations, is mechanically prevented by means of the support element.

A thin-walled coating is achieved by the slide alloy that is applied to at least one closure lid, for radial and axial bearing of the stator housing relative to the rotor shaft. This coating is resistant to vibrations, as compared with slide bearings that are pressed in, which tend to come loose under strong vibrations. Alternatively or supplementally, the rotor shaft can be at least partially unreleasably cast-surrounded with a slide alloy, in order to achieve this advantage. It is advantageous if the slide alloy is a lead/bronze alloy.

In a further development of the invention, the stator vane of the stator housing is formed onto the side of the gear wheel that faces the rotor shaft. In this way, more effective utilization of the construction space is achieved. Furthermore, the torque of the oscillation motor can be increased, taking advantage of the gear wheel body, while keeping the axle distance the same. A vibration-stressed parting point is avoided and the number of individual parts is reduced.

In an embodiment of the invention, the oscillating motor has means for locking the stator housing to the rotor shaft. In this way, a change in position due to internal leakages is avoided. Since the hydraulic pressure can be lowered in the locked state of the stator housing, the seals are subject to clearly less stress, and this results in less friction wear of the seals, since the press-down forces are clearly lower in the pressure-free state. Furthermore, a saving in energy is brought about, since no adjustment or re-adjustment of the oscillating motor is necessary over the time period of operation of the vibrator. Furthermore, the required regulation of the oscillating motor is simplified.

In an advantageous embodiment, the means for locking can be hydraulically activated. In this way, the braking system can be connected to the existing hydraulics.

Preferably, the means for locking is formed by a spring-pressure multiple-disk brake. Such multiple-disk brakes require only a small construction space.

The invention also relates to an oscillating motor for use in a vibration exciter, which allows a constant setting of the imbalances, with simultaneous avoidance of leakages of the hydraulic system, in working operation of the vibration exciter. The motor comprises a rotor shaft and a stator housing, between which working chambers are formed. The stator housing (62) can rotate about the rotor axle. The stator housing has at least one closure lid that is at least partially unreleasably coated with a slide alloy, for radial and axial bearing of the rotor shaft. At least one shaft seal is disposed between the rotor shaft and stator housing. This seal is hydraulically biased and provided with a support element.

With the invention, an oscillating motor for use in a vibration exciter is created, which makes possible a constant setting of the imbalances, with simultaneous avoidance of leakages of the hydraulic system, in working operation of the vibration exciter.

The at least one shaft seal disposed between rotor shaft and stator housing, which is hydraulically biased and provided with a support element, prevents external leaks at the shaft seals in an operating state with low operating pressure. Lifting of the sealing edge of the shaft seal, at high speeds of rotation or vibrations, is mechanically prevented the support element.

The slide alloy applied to the at least one closure lid, for radial and axial bearing of the stator housing with regard to the rotor shaft, achieves a thin-walled coating, which is vibration-resistant as compared to slide bearings that are pressed in, which tend to come loose under strong vibrations. Furthermore, the thin-walled coating is suitable for absorbing the stresses that result from shaft bending and mass forces, because of the great strength of the base material of the lid, with simultaneously good slide properties. The processability of the bearing point allows a very slight bearing play as compared to bearings to be pressed in, and this in turn guarantees a slight relative movement between shaft with rotor and housing with stator. Lower mass forces that are in effect between shaft with rotor and housing with stator result from the low bearing play.

Alternatively or supplementally, the rotor shaft can be at least partially unreleasably cast-surrounded with a slide alloy. It is advantageous if the slide alloy is a lead/bronze alloy.

In a further development of the invention, means for locking the stator housing relative to the rotor shaft are provided. In this way, a change in position due to internal leakage is further avoided. Since the hydraulic pressure can be lowered in the locked state of the stator housing, the seals are subject to clearly less stress, and this results in less friction wear of the seals, since the press-down forces are clearly lower in the pressure-free state.

It is advantageous if the means for locking can be hydraulically activated. In this way, it is possible to connect the braking system to the existing hydraulics.

Preferably, the means for locking is formed by a spring-pressure multiple-disk brake. In this way, compact construction is made possible.

In an embodiment of the invention, a gear wheel is disposed on the stator housing, which is configured, on its inside that faces the rotor shaft, as a stator having a stator vane. In this way, effective utilization of the construction space is brought about. Furthermore, the torque of the oscillating motor can be increased, utilizing the gear wheel body, while keeping the axle distance the same. A parting point that might be subject to vibration stress is avoided, and the number of individual parts is reduced.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
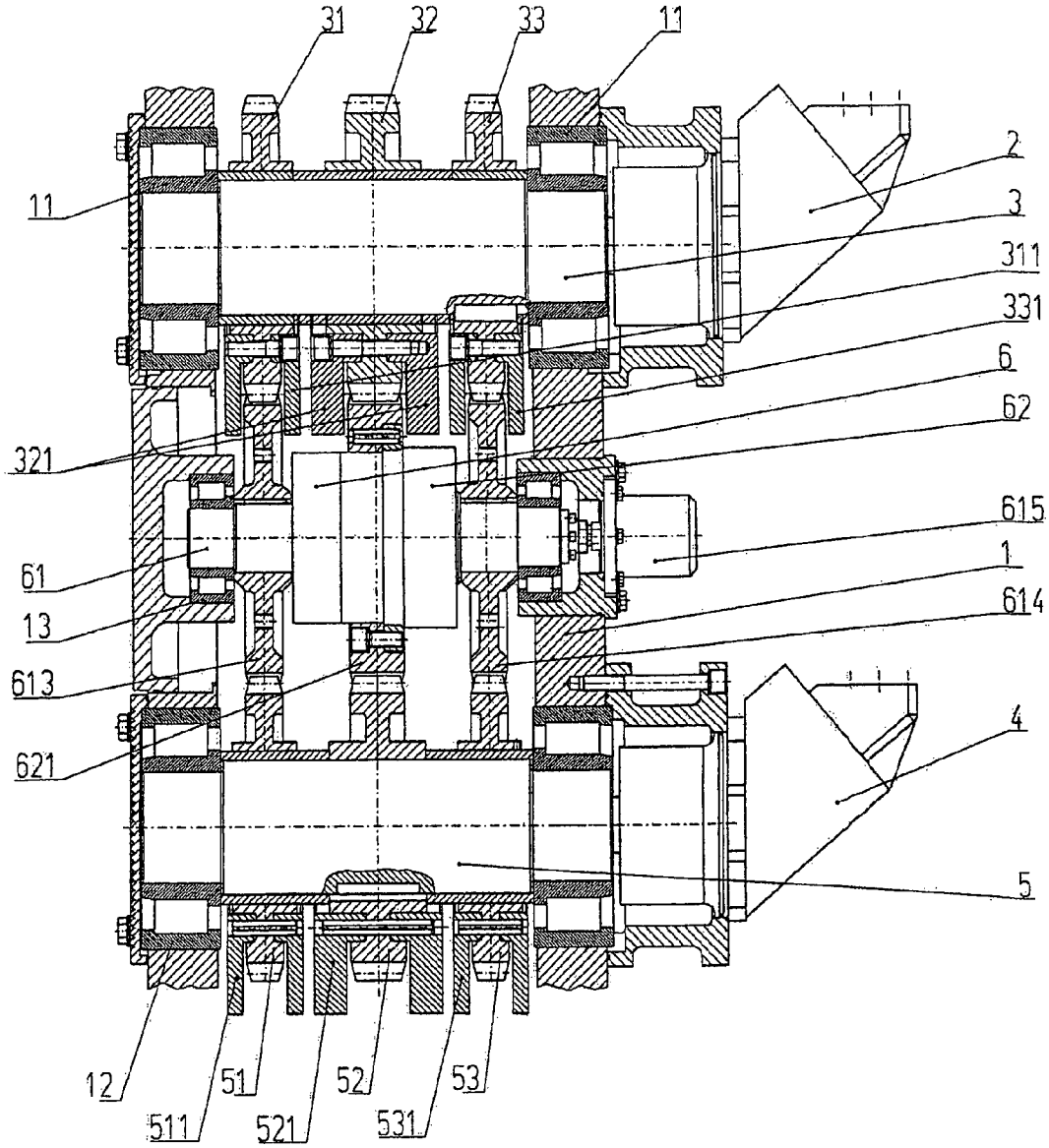
FIG. 1 shows the representation of a vibrator gear mechanism in longitudinal section.

Referring now in detail to the drawings, the vibration generator selected as an exemplary embodiment is configured as a vibrator gear mechanism, as shown in FIG. 1. It essentially consists of a housing 1 in which two shafts 3, 5 provided with gear wheels 31, 32, 33 and 51, 52, 53, respectively, are mounted to rotate, as well as of an oscillating motor 6, the rotor shaft 61 of which is provided with gear wheels 613, 614, and the stator housing 62 of which is provided with a gear wheel 621.

Shaft 3 is mounted to rotate in bearings 11 of housing 1. An outer gear wheel 31 is disposed on shaft 3, mounted to rotate; opposite outer gear wheel 33 is connected to rotate with the shaft 3. Gear wheels 31, 33 are provided with imbalance masses 311, 331, in each instance. In the center between the gear wheels 31, 33, a gear wheel 32 is furthermore disposed on shaft 3, mounted to rotate. Gear wheel 32 is also provided with an imbalance mass 321. In the embodiment shown, shaft 3 is connected with a drive 2.

Opposite shaft 3, a shaft 5 is furthermore mounted in housing 1, so as to rotate, by means of bearings 12. Shaft 5 is provided, in the same manner as shaft 3, with three gear wheels 51, 52, 53, on which imbalance masses 511, 521, 531 are attached. On shaft 5, however, in contrast to shaft 3, outer gear wheels 51, 53 are connected with shaft 5 so that they can rotate; gear wheel 52 disposed between gear wheels 51, 53 are attached to shaft 5 in a fixed manner, so as to rotate with it. In the exemplary embodiment, shaft 5 is connected with a drive 4.

A shaft 61 is mounted in housing 1, so as to rotate, between shafts 3, 5, by way of bearings 13. Shaft 61 is essentially the rotor shaft of an oscillating motor 6 that is disposed centered on it. On both sides of oscillating motor 6, gear wheels 613, 614 are disposed on shaft 61, in fixed manner, so as to rotate with it. Gear wheels 613, 614 are positioned on shaft 61 in such a manner that they are in engagement with gear wheels 31, 51 and 33, 53, respectively, of shafts 3, 5. Furthermore, a gear wheel 621 is disposed on stator housing 62 of oscillating motor 6, fixed in place, so as to rotate with it. Gear wheel 621 is positioned on stator housing 62 in such a manner that it engages gear wheels 32, 52 of shafts 3, 5. Shaft 61 is furthermore connected with a rotary passage 615 that projects out of housing 1.

Figure 6:
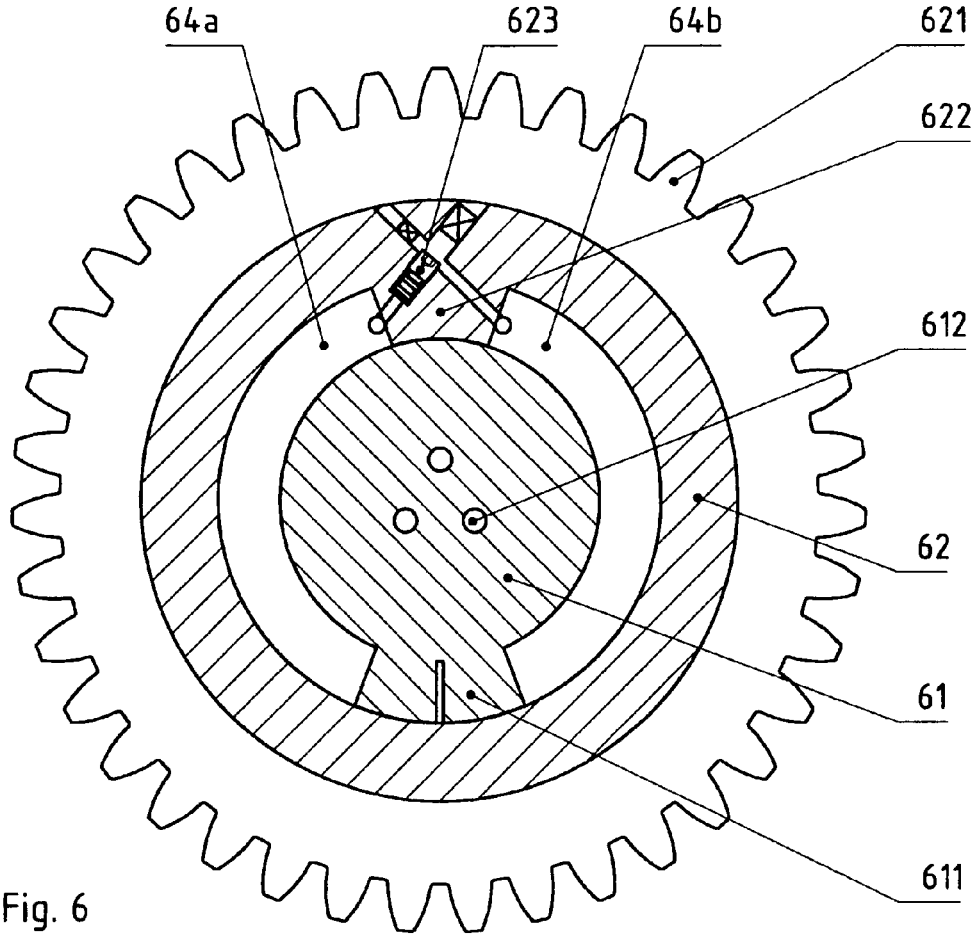
FIG. 6 shows the representation of the oscillating motor from FIG. 5 in cross-section along the line VI-VI.
Figure 7:
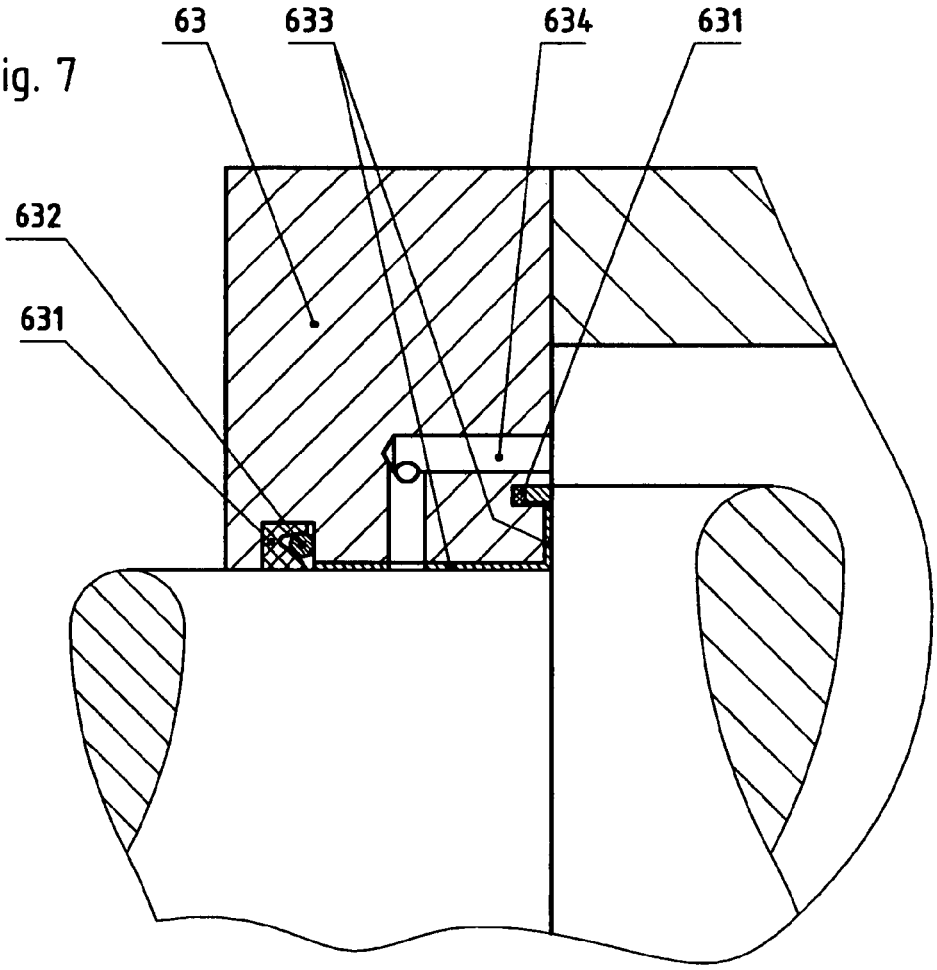
FIG. 7 shows the detail view of the cut-out VII from FIG. 5.

Oscillating motor 6 is essentially formed by rotor shaft 61 and a stator housing 62 that surrounds the shaft 61, as well as by two closure lids 63 that are disposed on both sides of the stator housing. An intermediate space is formed between rotor shaft 61 and stator housing 62, which space is divided by means of a rotor vane 611 formed onto rotor shaft 61 and by a stator vane 622 formed onto stator housing 62, so that two working chambers 64*a*, 64*b* are formed. In the exemplary embodiment, stator vane 622 is formed directly onto the inside of gear wheel 621, so that stator housing 62 is formed in one piece with gear wheel 621 and stator vane 622. To implement a pressure-dependent bias force of inner seals 631 of oscillating motor 6, an alternating valve 623 is disposed in stator vane 622, the control channels of which open into working chambers 64*a*, 64*b* on the two sides of the stator vane (see FIG. 6). Furthermore, channels 612 for supplying media to the two working chambers and to multiple-disk brake 65, by means of the hydraulic system, are worked in along shaft 61.

Figure 5:
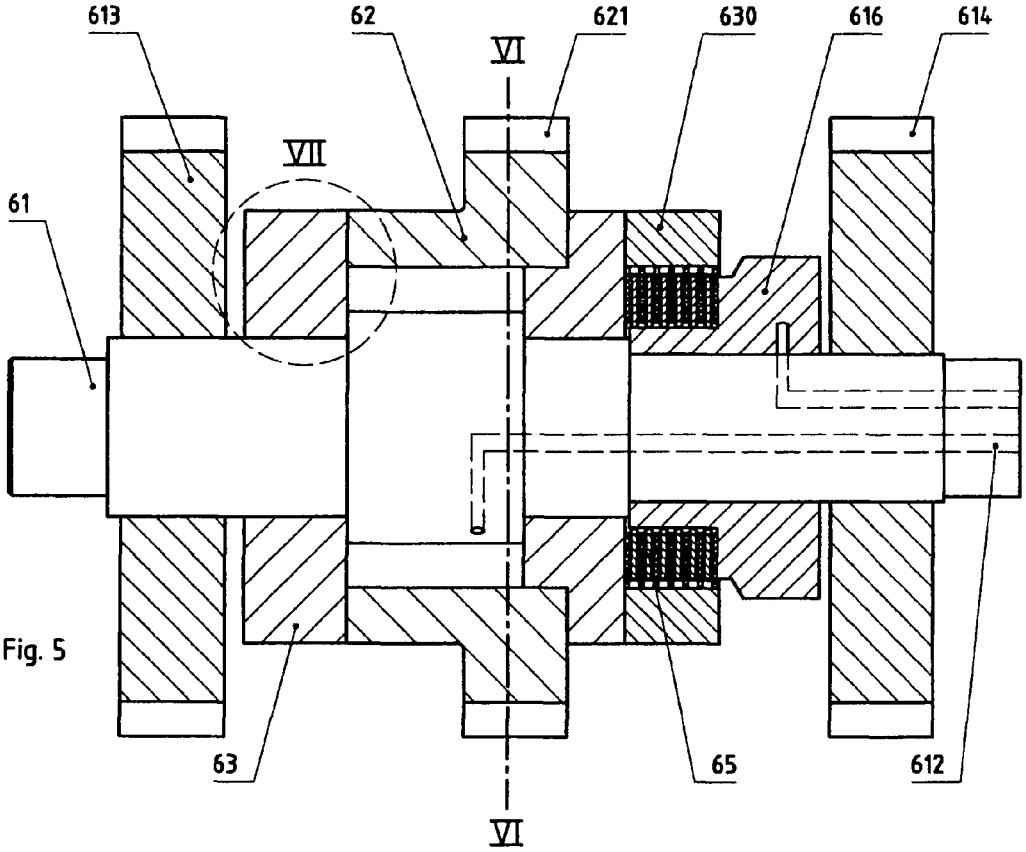
FIG. 5 shows the representation of a rotor oscillating motor having a spring-pressure multiple-disk brake, in longitudinal section.

In the embodiment according to FIG. 5, the oscillating motor is provided with a multiple-disk brake 65. Multiple-disk brake 65 consists of a housing 630 attached to lid 63 of stator housing 62, a hub 616 attached to shaft 61, and a clutch disk package 65. When the clutch disks that mesh with housing 630 are mechanically pressed against the clutch disks that mesh with the hub connected with rotor shaft 61, by means of spring force (or alternatively, hydraulically), stator housing 62 locks to rotor shaft 61.

Stator housing 62 is sealed with regard to rotor shaft 61 by means of seals 631. Seals 631 are biased both hydraulically and mechanically with elastic elements, and are additionally pressed, with pressure, against the corresponding counter-surfaces, by means of alternating valve 623 integrated into the oscillating motor, only when pressure is applied to working chambers 64*a*, 64*b*. Therefore a very good seal and thus a high volumetric degree of effectiveness is achieved over the time period of the adjustment, in other words in the state when pressure is applied. In the pressure-free state, the hydraulic press-down force is completely absent, with the advantage of a reduction in friction wear.

In order to avoid external leaks at shaft seals 631 in an operating state with low operating pressure, these are additionally provided with a support element 632. Support element 632 prevents lifting of the sealing edge at high speeds of rotation. To support the sealing effect of seals 631, hydraulic channels 634 are worked into lid 63.

A slide alloy 633 is affixed to lids 63, for axial and radial bearing of the rotor shaft in lids 63 of the stator housing 62, which alloy is unreleasably cast-filled into lids 63. In this way, a thin-walled, vibration-resistant coating is formed, which is suitable for absorbing the stresses that result from shaft bending and mass forces, while simultaneously providing good sliding properties. In the embodiment shown, slide alloy 633 is a lead/bronze alloy that combines the high mechanical properties of the base material of lid 63 with the excellent slidability of the alloy components, because of the thin-walled configuration.

In the start-up phase of the vibrator, imbalance masses 311 and 331 are oriented, with regard to imbalance mass 321, in such a manner that the resulting imbalance is equal to zero. The gear wheel 33 is driven by way of shaft 3, which stands in connection with drive 2, and drives gear wheel 614 of shaft 61, thereby causing oscillating motor 6 that is connected with shaft 61 to rotate. Gear wheel 613 and, in the same manner, gear wheel 31 are driven by way of shaft 61.

Shaft 5, with gear wheel 52 disposed on it in fixed manner, so as to rotate with it, is put into rotation by way of synchronously controlled drive 4. The gear wheel, in turn, engages gear wheel 621 of stator housing 62. Gear wheel 32 of shaft 3 is rotated by gear wheel 621 of stator housing 62; the former is mounted on shaft 3, so as to rotate. At the end of the start-up phase, one of working chambers 64*a*, 64*b* has excess pressure applied to it by hydraulic channels 612, regulated by way of an external directional valve, so that gear wheel 621 is rotated relative to rotor shaft 61 and therefore also relative to gear wheels 613, 614, which are connected with rotor shaft 61 so as to rotate with it.

In the same manner, the rotary position of gear wheels 32, 52 that engage gear wheel 621 of stator housing 62 is changed, so that imbalance masses 321, 521 are brought out of equilibrium with regard to imbalance masses 311, 331, 511, 531, thereby bringing about a resulting imbalance. The degree of vibration can be adjusted in a stepless manner, by adjusting the degree of rotation of gear wheel 621 with regard to gear wheels 613, 614 of rotor shaft 61.

Once the desired degree of vibration has been reached, multiple-disk brake 65 is mechanically activated by spring force, with hydraulic pressure relief, thereby locking stator housing 62 to rotor shaft 61. After locking, no further regulation of the position of the oscillating motor by way of the hydraulics is required, so that the pressure application can now be shut off, relieving stress on the seals. Subsequently, the actual pile-driving process can be carried out.

Since oscillating motor 6 is now only operated in the load-free state of the vibrator, and is relieved of stress due to the locking by means of multiple-disk brake 65 during the pile-driving process, a clearly lesser construction size of the oscillating motor is made possible.

Figure 2:
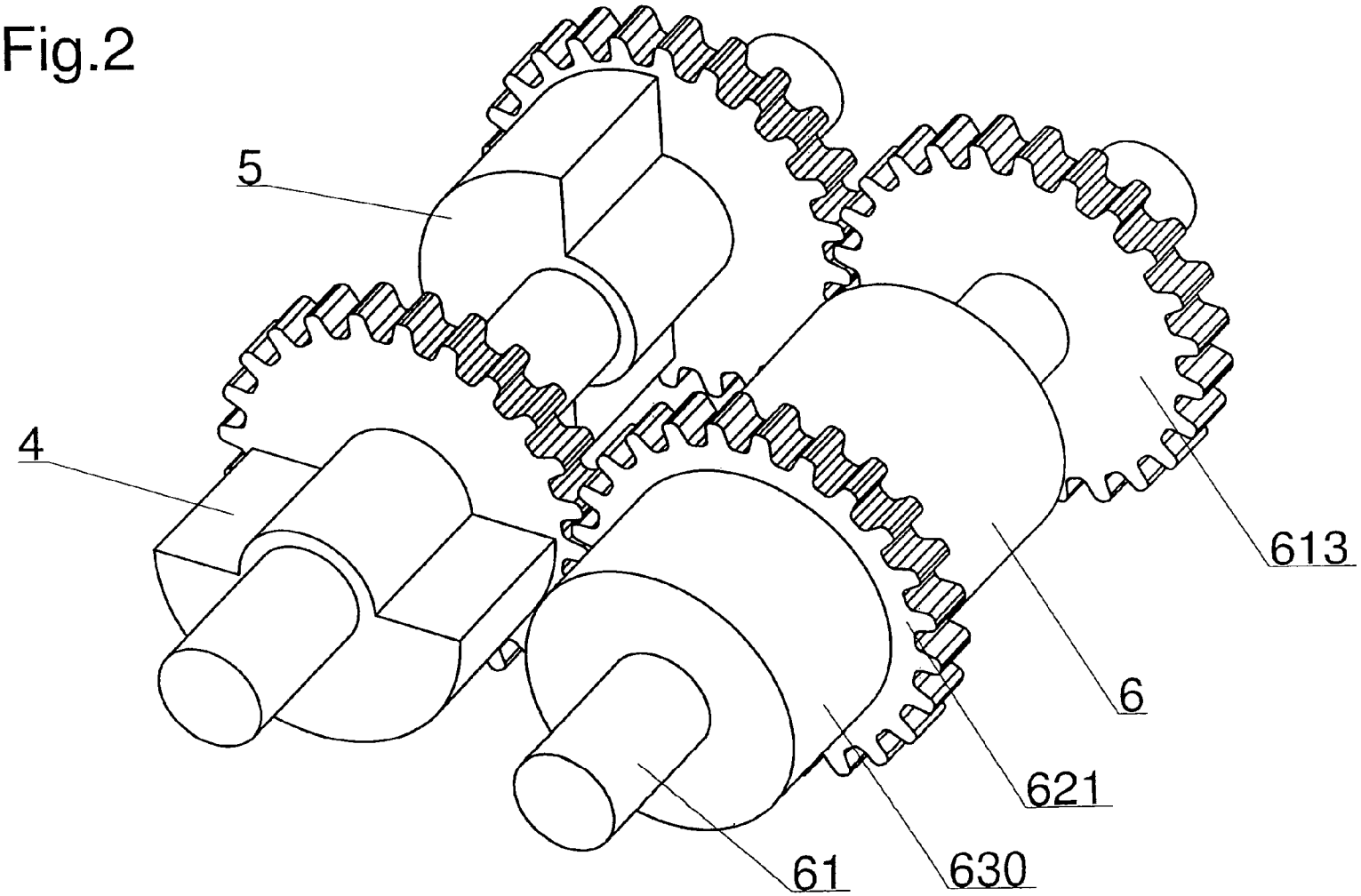
FIG. 2 shows a fundamental representation of an imbalance adjustment indexed to an oscillating motor, having an axle loaded with an imbalance.
Figure 3:
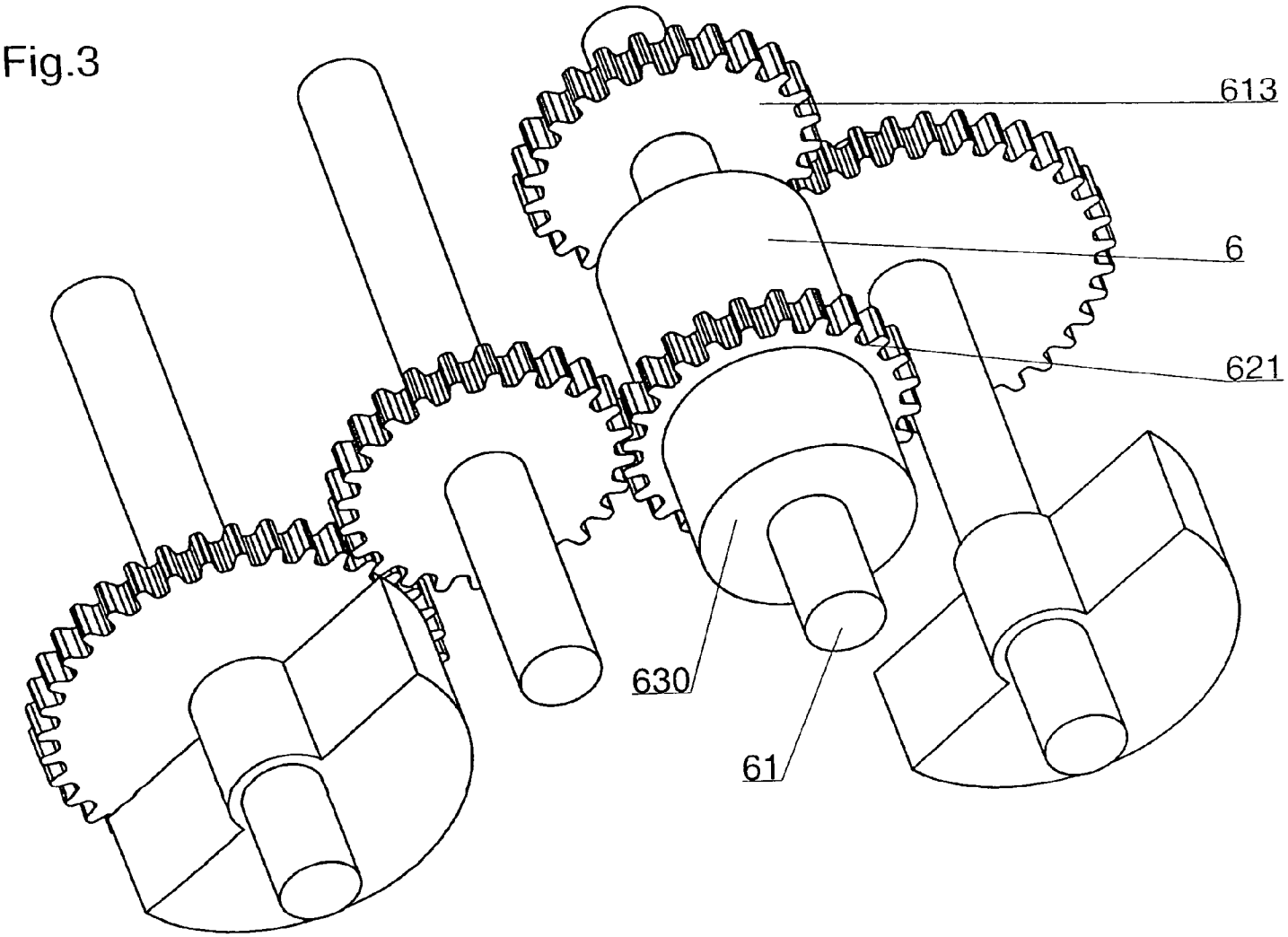
FIG. 3 shows a fundamental representation of an imbalance adjustment indexed to an oscillating motor, having two axles loaded with an imbalance, for adjusting the force direction.
Figure 4:
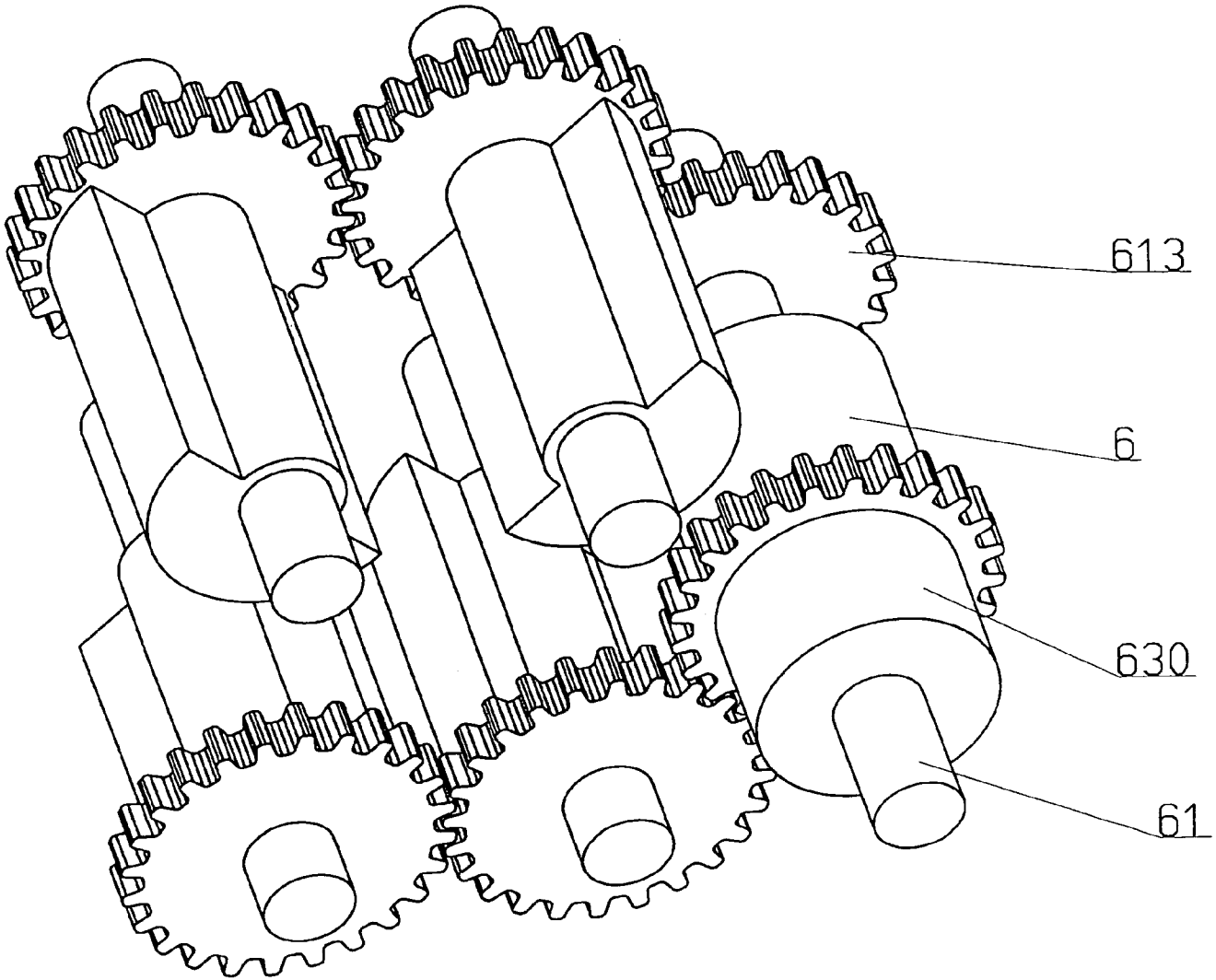
FIG. 4 shows the fundamental representation of an imbalance adjustment indexed to an oscillating motor, with shafts loaded with imbalances, disposed in pairs.

To make the imbalance regulation by means of the rotor oscillating motor, according to the present invention, clear, different shaft and imbalance mass arrangements are shown schematically in FIGS. 2 to 4. Of course, the present invention is not limited to the arrangement shown as an example.

FIG. 3 shows a possibility of adjusting the force direction. In the case of soil compactors, for example shaker plates, a movement direction can be achieved in this manner. In this connection, oscillating motor 6 changes the angular position of the imbalances relative to one another, by way of gear wheels 613 and 621.

Accordingly, while only a few embodiments of the present invention have been shown and described, it is obvious that many changes and modifications may be made thereunto without departing from the spirit and scope of the invention.

What is claimed is:

1. A vibration exciter, comprising:

at least two axles disposed parallel to one another;

at least two imbalance masses, which are attached to one or more of the axles, means for adjusting a relative rotary position of the imbalance masses relative to one another, said means comprising at least one rotary oscillating motor having a rotor shaft and a stator housing, wherein the rotor shaft is an integral part of one of the axles, and a rotary position of the stator housing relative to the rotor shaft can be changed;

at least one closure lid on the stator housing that is at least partially unreleasably coated with a slide alloy, for radial and axial bearing of the rotor shaft; and at least one shaft seal disposed between the rotor shaft and stator housing, said seal being hydraulically biased and provided with a support element.

2. A vibration exciter according to claim 1, wherein the rotor shaft is at least partially unreleasably coated with a slide alloy.

3. A vibration exciter according to claim 1, further comprising a gear wheel disposed on the stator housing, which gear wheel is configured as a stator having at least one stator vane on its inside that faces the rotor shaft.

4. A vibration exciter according to claim 1, wherein the oscillating motor has means for locking the stator housing to the rotor shaft.

5. A vibration exciter according to claim 4, wherein the means for locking is hydraulically activated.

6. A vibration exciter according to claim 4, wherein the means for locking is formed by a spring-pressure multiple-disk brake.

* * * * *